US005700173A

United States Patent [19]

Lerro

[11] Patent Number: 5,700,173

[45] Date of Patent: Dec. 23, 1997

[54] SWIMMING INSTRUCTIONAL DEVICE

[76] Inventor: Sam M. Lerro, 8 Fountain of Youth Blvd., St. Augustine, Fla. 32084

[21] Appl. No.: 595,177

[22] Filed: Feb. 1, 1996

[51] Int. Cl.[6] ..... A63B 31/02

[52] U.S. Cl. ..... 441/57; 441/59; 441/60

[58] Field of Search ..... 441/55, 56–64

[56] References Cited

U.S. PATENT DOCUMENTS

| | | | |
|---|---|---|---|
| 2,006,915 | 7/1935 | Ferber | 441/59 |
| 3,286,287 | 11/1966 | Martin | 441/59 |
| 4,040,136 | 8/1977 | Garcia | 441/59 |
| 4,828,521 | 5/1989 | Harrington | 441/60 |

FOREIGN PATENT DOCUMENTS

| | | | |
|---|---|---|---|
| 1391148 | 1/1965 | France | 441/55 |
| 2108053 | 5/1983 | United Kingdom | 441/59 |

*Primary Examiner*—Stephen Avila

*Attorney, Agent, or Firm*—Thomas C. Saitta

[57] ABSTRACT

A swimming instructional and training aid comprising a combination floatation and positioning member adapted to encircle or attach to a body joint of the extremities, i.e., the knee, ankle/foot, elbow and wrist/hand joints, the member being relatively rigid yet retaining some flexibility and configured to restrictively maintain the body joint in a preferred angular position as determined by proper swimming technique, the member being comprised of a buoyant material whereby the body joint is lifted to the surface of the water when the member is in place.

20 Claims, 1 Drawing Sheet

SWIMMING INSTRUCTIONAL DEVICE

BACKGROUND OF THE INVENTION

The invention is in general a swimming instruction and training aid which comprises an individual device or a combination of individual devices, each individual device comprising a member adapted to restrict movement of and properly position a body joint of the extremities, such as an ankle, knee, elbow or wrist, while simultaneously providing floatation or buoyancy to lift the particular body joint to the surface of the water, as well as properly positioning the body in a horizontal manner.

Proper swimming technique requires that the leg kick, arm stroke and head positioning be performed correctly, which means that the proper relative positions and angles of the body joints, such as the foot, ankle, knee, hand, elbow and neck, must be maintained. In teaching non-swimmers, especially children, the major obstacle to overcome is the person's natural fear of the water. A beginning swimmer, in struggling to maintain the head above the surface of the water, almost universally adopts a generally vertical position in the water because of the natural buoyancy of the chest area—torso almost upright, head erect, legs and feet beneath the torso performing a cyclical motion with bent knees and feet perpendicular to the legs—a motion similar to pedaling a bicycle. This is the antithesis of the proper horizontal swimming position. Distilled to a very basic level, good swimming instruction teaches the student to adopt the proper horizontal position in the water and to maintain the body joints in the proper position and alignment during the kick and stroke.

Prior swimming instructional devices have always focused only on the floatation problem without concern for the joint positioning problem. For example, Brandt in U.S. Pat. No. 3,170,175 and Lennon in U.S. Pat. No. 4,804,326 both disclose tubular floatation members which are designed to encircle the swimmer's ankles to raise the feet and legs into a horizontal position at or near the surface of the water. Such devices help to overcome the beginner's tendency to adopt an incorrect body position in the water, but may be counterproductive mentally and technically in that the swimmer may now focus too much on maintaining the unbuoyed body parts and joints—the arms hands, head, torso—above water. More importantly, as shown in FIG. 1 of the Lennon patent, the devices do nothing to promote the proper positioning and alignment of either the body joint on which the device is worn, in this case the ankle, or the other body joints, such as the knee, which are crucial to proper swimming technique.

It is an object of this invention to provide devices for use in swimming instruction which properly position a body joint of the extremities in the correct angular alignment while simultaneously providing buoyancy to the joint to float the joint at or near the surface of the water. It is a further object to provide such a device which can be adapted for the ankle/foot joint, the knee joint, the elbow joint or the wrist/hand joint. It is a further object to provide such a device which is semi-rigid, such that the proper positioning of the body joint is maintained or suggested during swimming without overly restricting the joint, whereby the joint is not locked into the position but can be flexed if sufficient force is applied. It is a further object to provide for the use of a combination of multiple devices on different joints to further facilitate horizontal positioning and floatation of the entire body and instruction of the proper technique for stroke and kick.

SUMMARY OF THE INVENTION

The invention is a swimming instructional and training aid which comprises in general a combination floatation and positioning member adapted to encircle or attach to a body joint of the extremities, i.e., the arms or legs, the member being relatively rigid yet retaining some flexibility and configured to restrictively maintain the body joint in a preferred angular position as determined by proper swimming technique, the member being comprised of a buoyant material whereby the body joint is lifted to the surface of the water when the member is in place. The device may be constructed from any of a number of suitable floatation materials, and may comprise air-entrapping compartments, such as sealable plastic envelopes or tubes, or foam polymers of differing flexibility, such as styrofoam or the like. The required rigidity of the device may be a function of the materials of construction themselves, such as a properly shaped polymer foam member of sufficient thickness to resist flexing, or flexible spring or brace members may be attached to or incorporated within a less rigid floatation material. The device is designed to be worn in pairs, such that a pair of the devices is worn on each set of corresponding body joints.

The devices are properly configured relative to a particular body joint of the extremities to restrictively position that joint in the proper manner as dictated by optimum swimming technique. The device for the ankle/foot joint is configured such that the foot is maintained in an extended or pointed position relative to the ankle. The device for the knee joint likewise maintains the knee is an extended or non-bent position. The device for the wrist/hand joint is configured to align the hand with the forearm, impeding backward flexing of the wrist. The device configured for the elbow is preferably less restrictive than those for the other body joints, in that the elbow should be allowed to move from a bent position of up to 90 degrees to a straight position. The combination of the ankle/foot and knee devices results in proper horizontal positioning of the body in the water due to the floatation factor and also provides for proper angular alignment of these most critical joints, due to the restrictive or suggestive positioning factor, which forces the beginner to adopt proper kick technique. The combination of the wrist/hand and elbow devices provides for proper hand, forearm, upper arm and shoulder positioning during the stroke, due to the restrictive positioning and buoyancy factor of the wrist/hand and elbow devices preventing the arm and hand from penetrating too deeply into the water. The combination of the wrist/hand and elbow devices also results in proper body motion technique by causing the body to automatically produce the proper lift-and-roll forward movement during the pull stroke.

The devices may be constructed in a tubular or sleeve-like fashion, requiring them to be slipped into position over the joints, or they may be constructed in a wrap-around fashion with one or more longitudinal slits and closure means, such as hook-and-loop fasteners, snaps, buckles or the like, to maintain the devices in place.

DETAILED DESCRIPTION OF THE INVENTION

With reference to the drawings, the invention will now be described in detail with regard to the best mode and preferred embodiment. The invention is a swimming instructional device for teaching non-swimmers or for perfecting swimming technique in beginning swimmers. The device is a combination floatation and body positioning member comprising in general body joint positioning means which is adapted to maintain a particular body joint—the ankle/foot joint, knee joint, elbow joint or wrist/hand joint—in the proper relative position or angular alignment for optimum swimming efficiency while simultaneously providing sufficient buoyancy to float the body joint to the surface of the water through floatation means. The floatation factor overcomes the fear of sinking commonly found in non-swimmers and also promotes proper horizontal positioning of the body or the extremities by preventing the non-swimmer from assuming a relatively vertical alignment in the water. Once the beginning or non-swimmer has overcome the fear of sinking, the student can concentrate on proper swimming technique. By virtue of the fact that the device properly positions the body joint in the preferred alignment for optimum swimming efficiency, the student experiences the feel of the water flow and pressure sensations resulting from proper technique since the device, especially when used in multiple combinations, in effect forces even the non-swimmer to adopt proper technique and easily move through the water. The non-swimmer experiences the feel of proper technique from the very beginning without having to unlearn the feel of any improper techniques. The device is to be worn in pairs for each body joint, such that for example one device is worn on one knee joint and another corresponding device is worn on the other knee joint.

Figure 1:
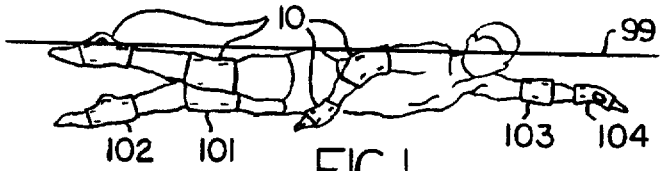
FIG. 1 is a view of a swimmer wearing the invention on the ankle/foot joints, the knee joints, the elbow joints and the wrist/hand joints.

As shown in FIG. 1, the combination floatation and positioning device, generally depicted as member 10, is adapted for use on different body joints. The device may be configured for use on the ankle/foot joint, the knee joint, the elbow joint, or the wrist/hand joint. Each device 10 will independently act to properly position the body joint in the preferred angular or alignment position, and at the same time float the body joint to the surface of the water 99. Devices 10 positioned on the knees or ankles cause the legs to be raised into the horizontal position shown, preventing a non-swimmer from adopting the incorrect alignment with torso and head generally vertically disposed and the feet and legs moving in a pedaling manner.

Figure 2:
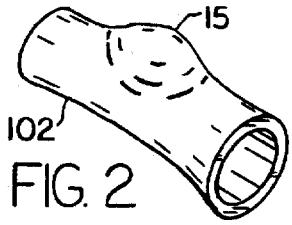
FIG. 2 is a view of the device configured for the ankle/foot joint.
Figure 3:
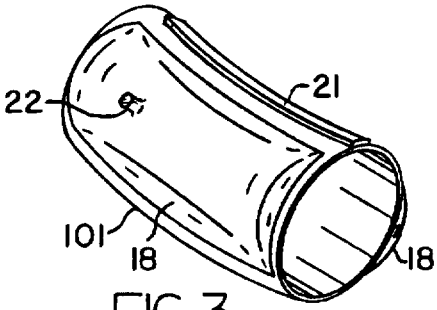
FIG. 3 is a view of the device configured for the knee joint.
Figure 4:
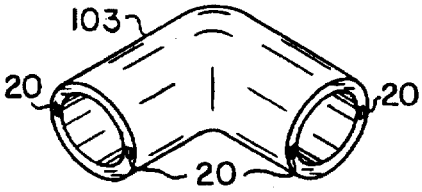
FIG. 4 is a view of the device configured for the elbow joint, showing additional bracing.
Figure 9:
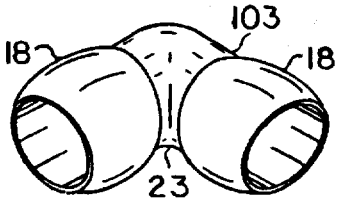
FIG. 9 is a view of a preferred embodiment for the elbow device.

The swimming instructional device 10 must be sufficiently buoyant to raise the body joint to the water surface and must be relative rigid so as to maintain the body joint in the proper position, without being too rigid such that the joint is locked into a position. The device 10 in effect suggests the proper position, such that flexing the joint out of proper alignment requires a conscious effort on the part of the student. With the student concentrating on swimming technique, this suggestive restriction is sufficient to maintain proper joint position. The floatation means for buoyancy is accomplished in a relatively simple manner by constructing the device 10 from materials which entrap air. For example, the device 10 may comprise layers of plastic joined to form sealed or sealable pockets or envelopes 18 which are impermeable to air, as shown in FIGS. 3 and 9. More preferably, the device 10 is constructed from materials which are inherently buoyant, such as an extruded polymer foam which contains numerous closed cells filled with entrapped air, such as shown in FIGS. 2 and 4.

The use of extruded polymer foam is also preferable in that the required rigidity can be engineered into the device 10 by proper selection of material density and thickness. The device 10 should not completely prevent flexation of the body joint, as the ability to intentionally move the body joint is reassuring to the student and also may be necessary for such tasks as putting on or removing the device 10, or for standing or walking. The rigidity of the device 10 maintains the body joint in the proper position unless the restriction is countered by the student by conscious effort. In an alternative construction, the rigidity may be supplied or enhanced by providing relatively rigid yet flexible spring or brace members 20, as shown in FIGS. 4, 6, 7 and 8, preformed in the proper contour for the particular body joint. The spring members 20 can be attached on either the interior or exterior, can be placed into receiving pockets 21 or positioned internally within the walls of the device 10.

Figure 5:
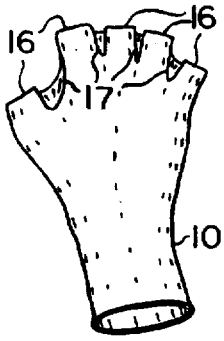
FIG. 5 is a view of the device configured for the wrist/hand joint.
Figure 6:
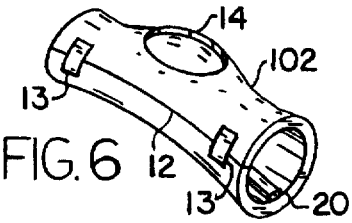
FIG. 6 is a view of the device configured for the ankle/foot joint, showing a wrap-around configuration with additional bracing.
Figure 7:
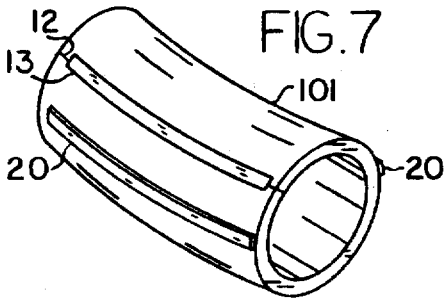
FIG. 7 is a view of the device configured for the knee joint, showing a wrap-around configuration with additional bracing.
Figure 8:
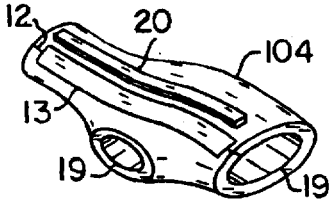
FIG. 8 is a view of the device configured for the wrist/hand joint, showing a wrap-around configuration with additional bracing.

The combination floatation and positioning member 10 can be configured in a generally open-ended tubular or sleeve shape, as shown in FIGS. 2, 3, 4 and 5, such that the device 10 is slipped onto the legs or arms of the student, or it may be constructed with a longitudinal slit 12, as shown in FIGS. 6, 7 and 8, which allows the device 10 to be wrapped around the body joint and secured by a closure means 13. The closure means 13 may comprise any fastener suitable for use in a water environment, and is preferably comprised of a hook-and-loop type fastener.

As shown in the individual figures, the member 10 is particularly configured to match a particular body joint. The most important joint to properly position for optimum swimming technique and for maintaining the body in the correct horizontal floating position is the knee joint, with the corresponding construction for the member 101 shown in FIGS. 3 and 7. The knee joint device 101 is generally tubular with only a slight built-in flex, matching the natural angle of a non-flexed knee joint, to maintain the leg in the extended position. The device 101 extends a short distance onto the upper and lower leg to either side of the knee joint itself. As shown in FIG. 3, the knee device 101 can be configured as an open-ended sleeve which requires it to be slipped over the foot and pulled up the leg. Alternatively, as shown in FIG. 7, the knee device 101 may be provided with a longitudinal slit 12 and closure means 13, such as a hook-and-loop fastener, allowing the knee device 101 to be wrapped around the knee joint. One or more spring brace members 20, preferably formed of relatively rigid yet somewhat flexible elongated plastic members, may be longitudinally affixed to the device 101 to retard flexing of the knee. The spring brace members 20 may be attached externally as shown in FIG. 7, internally or implanted within the body of the device itself.

The spring members 20 may be directly attached to the material of construction or placed into pockets members 21 as shown in FIG. 3. When both knees are encased in devices 101, the proper angular position for the knee is suggested and maintained by the positioning means, and the legs are buoyed to the surface of the water 99 by the floatation means, causing the student to float horizontally in the water rather than vertically, as shown in FIG. 1.

The device 102 configured for the ankle/foot joint is designed to accommodate the heel of the student, either by a cut-out portion 14 as shown in FIG. 6 or a raised portion 15 as shown in FIG. 2, and extends a short distance over the foot itself and above the ankle onto the lower leg to maintain the foot in the proper extended position relative to the lower leg. The ankle/foot device 102 can be formed in an open-ended tubular shape as shown in FIG. 2 or provided with a longitudinal slit 12 and closure means 13, such as a hook-and-loop fastener, as shown in FIG. 6. Spring brace members 20 can be affixed longitudinally either permanently or removably, on the exterior, interior as shown in FIG. 6, or incorporated within the body of the device itself. When worn, the ankle/foot device 102 causes the foot to be positioned in the proper angular alignment, although the device 102 itself and the spring members 20, if present, are preferably flexible enough to allow the student to bend the ankle for standing or walking purposes. The buoyancy of the ankle/foot device 102 lifts the foot to the surface of the water 99 and reinforces the horizontal positioning resulting from the knee device 101.

The device 103 for the elbow joint, shown in FIG. 4, is constructed to allow for more flexibility than the other joints, since the elbow must go through a range of motion from an extended position to a flexed position of almost 90 degrees. Since the bent position is maintained over the majority of the stroke, the elbow device 103 is preformed to be flexed in this bent position, such that the student must push against the restrictive configuration of the elbow device 103 to extend the arm for insertion into the water during the entry phase of the stroke. The floatation and positioning effect resulting from the combination of the elbow devices 103 and the wrist/hand devices 104 automatically forces the body to lift and roll forward in the proper manner as the arm is brought in flexed position under the body during the pull phase of the stroke. As with the knee device 101 or the ankle/foot device 102, the elbow device 103 may be formed in either a wrap-around or a tubular manner, and is sized to extend a short distance on the upper and lower arm to either side of the elbow. Likewise, elbow device 103 may incorporate spring brace members 20 either externally, internally or implanted within the body of the device itself, as shown in FIG. 4. A preferred embodiment for the elbow device 103 is shown in FIG. 9, where the device 103 is constructed in two generally equal halves formed by separate adjustable air pockets 18 joined by a relatively flexible web member 23 adapted to be worn directly over the elbow joint. By constructing the elbow device 103 in two separately adjustable halves, the buoyancy of either the upper arm or the lower arm can be individually adjusted as desired to perfect the proper stroke technique.

The device 104 for the wrist/hand joint, as shown in FIGS. 5 and 8, is adapted to restrict the hand from flexing backward or forward toward the forearm, preferably extending to or beyond the knuckles and onto the forearm a short distance. For better use of the hands when wearing the device 104, the floatation components may be positioned only on the backside of the device 104. The wrist/hand device 104 may be configured with open ends 19 for the fingers, as shown in FIG. 8, or with truncated finger members 16, as shown in FIG. 5, and spring brace members 20 may be attached. Preferably, web members 17 are provided between the finger members 16. Web members 17 provide for greater propulsion by increasing the surface area pushing against the water during the pull stroke while simultaneously allowing the student to keep the fingers relaxed. The combination of the devices 103 and 104 worn on the wrist/hand joints and elbow joints forces the arm and hand up under the body during the pull phase of the stroke, causing the proper lift-and-roll forward motion of the upper body while at the same time preventing the student from extending the arm and hand incorrectly too far down into the water, since the proper technique requires the elbow to be bent during the pull stroke so that the hand and forearm is brought in under the chest.

The devices 10 may be used to effectively train the freestyle, back or butterfly strokes. Preferably, all four pairs of devices 10, the knee device 101, the ankle/foot device 102, the elbow device 103 and the wrist/hand device 104, are worn simultaneously in combination, as this results in proper horizontal positioning, proper alignment of all body joints and proper swimming technique. For the backstroke, additional buoyancy members may be worn around the waist and neck to more properly position the body in the water. This prevents beginners from improperly bending at the waist and from improperly lifting the head out of the water. In the most preferred embodiment, the devices 10 are provided with buoyancy adjustment means such as adjustably inflatable air pockets 18, as shown in FIGS. 3 and 9, the air pockets 18 having sealable stem members 22 to add or remove air. In this manner the amount of buoyancy can be adjusted initially to match the size and weight of the student, and later adjusted to match the proficiency level of the student. As the student becomes better at the proper technique, air can be removed in stages from the devices 10 to reduce the buoyancy until the student is swimming without any additional floatation. Likewise, with removable spring brace members 20, the amount of restriction can be adjusted by replacing the spring members 20 with more or less flexible ones or by removing them altogether.

It is understood that certain equivalents and substitutions of elements or components set forth above may be obvious to those skilled in the art, and the true scope and definition of the invention therefore is to be as set forth in the following claims.

I claim:

1. A swimming instructional and training device worn on an individual body joint chosen from the group of body joints consisting of the knee joint, the ankle/foot joint, the elbow joint and the wrist/hand joint, said device comprising in combination floatation means and positioning means, said positioning means restrictively positioning the body joint in the angular alignment equal to the technically correct angular alignment for proper execution of a standard swimming stroke in the absence of said device, said floatation means simultaneously lifting said body joint to the water surface to properly position the body joint in the water, and where said positioning means is flexible to the extent that the body joint can be flexed.

2. The device of claim 1, where said positioning means comprises a relatively rigid sleeve member adapted to encircle said body joint.

3. The device of claim 1, where said positioning means comprises a longitudinal slit and closure means, whereby said positioning means is adapted to be wrapped around said body joint.

4. The device of claim 1, where said positioning means comprises a spring brace member.

5. The device of claim 1, where said floatation means comprises a sealed pocket containing air.

6. The device of claim 5, where said sealed pocket comprises means to adjust the amount of air contained within said pocket.

7. The device of claim 4, where said spring brace member is removable.

8. A swimming instructional and training device comprising in combination a pair of body joint positioning members worn on the knee joints, each of said pair of body joint positioning members restrictively maintaining each of said knee joints in the proper angular alignment, said positioning member further comprising floatation means to simultaneously lift said knee joints to the water surface.

9. The device of claim 8, where each of said pair of positioning members comprises a relatively rigid sleeve member adapted to encircle said knee joints.

10. The device of claim 8, where each of said pair of positioning members comprises a longitudinal slit and closure means, whereby each said positioning member is adapted to be wrapped around said knee joints.

11. The device of claim 8, where each of said pair of positioning members comprises a spring brace member.

12. The device of claim 8, where said floatation means comprises a sealed pocket containing air.

13. The device of claim 12, where said sealed pocket comprises means to adjust the amount of air contained within said pocket.

14. The device of claim 11, where said spring brace member is removable.

15. A swimming instructional and training aid comprising in combination a pair of body joint positioning members adapted to be worn on the knee joints and a pair of body joint positioning members adapted to be worn on the ankle/foot joints, said body joint positioning members adapted to restrictively maintain said body joints in the proper angular alignment, said positioning members further comprising floatation means to lift said body joints to the water surface.

16. The swimming instructional and training aid of claim 15, further comprising a pair of body joint positioning members adapted to be worn on the elbow joints and a pair of body joint positioning members adapted to be worn on the wrist/hand joints.

17. The swimming instructional and training aid of claim 16, where at least one said pair of body joint positioning members further comprises spring brace members to provide additional rigidity.

18. The swimming instructional and training aid of claim 16, where at least one said pair of body joint positioning members further comprises adjustable air pockets.

19. The swimming instructional and training aid of claim 15, further comprising a pair of body joint positioning members adapted to be worn on the elbow joints.

20. The swimming instructional and training aid of claim 15, further comprising a pair of body joint positioning members adapted to be worn on the wrist/hand joints.

* * * * *